United States Patent [19]

Ryll et al.

[11] Patent Number: 5,064,379

[45] Date of Patent: Nov. 12, 1991

[54] PRINTED CIRCUIT BOARD CONTACT

[75] Inventors: Juergen Ryll, Egelsbach; Michael Gerst, Worms; Michael Schwäger, Langen, all of Fed. Rep. of Germany

[73] Assignee: AMP Incorporated, Harrisburg, Pa.

[21] Appl. No.: 605,604

[22] Filed: Oct. 30, 1990

[30] Foreign Application Priority Data

Oct. 30, 1989 [GB] United Kingdom ..... 8924359
Nov. 13, 1989 [GB] United Kingdom ..... 8925617

[51] Int. Cl.[5] ..... H01R 9/09; H01R 13/187

[52] U.S. Cl. ..... 439/81; 439/84; 439/839; 439/857

[58] Field of Search ..... 439/59, 62, 81, 82, 439/83, 84, 741, 249, 839, 856, 857, 870

[56] References Cited

U.S. PATENT DOCUMENTS 3,076,953 2/1963 Sloop ..... 439/857
3,601,775 8/1971 Longenecker ..... 439/857
3,818,423 6/1974 McDonough ..... 439/857
3,953,096 4/1976 Williams ..... 439/81
4,040,713 8/1977 Konnemann ..... 439/839
4,824,380 4/1989 Matthews ..... 439/510
4,828,503 5/1989 Gilissen ..... 439/62

FOREIGN PATENT DOCUMENTS 1239671 7/1988 Canada ..... 439/81

*Primary Examiner*—Neil Abrams
*Attorney, Agent, or Firm*—Eric J. Groen; Bruce J. Wolstoncroft

[57] ABSTRACT

An electrical pin receiving socket (2,102) is disclosed which includes a base portion (6,106) having side arms (8,108) extending upwardly to a top wall (10) or contact arms (112). Back-up springs are positioned proximate the contact arms and cooperate with the contact arms to ensure that the contact arms will electrically engage a mating pin. The base section (6,106) also includes printed circuit board contacts (20,30,120,130), where the contacts (20,30,120,130) are reversely bent under the base section (6,106) and then vertically downwardly to form printed circuit board contacts (26,36,126,136), thereby allowing the electrical pin receiving socket to move relative to the printed circuit board.

17 Claims, 7 Drawing Sheets

10
52
53
24
20
25
22
26
42
34
35
32
50
51
30
36

PRINTED CIRCUIT BOARD CONTACT

FIELD OF THE INVENTION

The subject invention relates to an improved contact for insertion into through holes of a printed circuit board and for receiving therethrough a pin terminal.

BACKGROUND OF THE INVENTION

The assignee of the above mentioned invention presently has a printed circuit board contact commercially available where the contact includes a base portion having printed circuit board legs extending directly downwardly from the base portion to be inserted into through hole sections of a printed circuit board The pin socket for the contact is formed by contact members extending from opposite side edges of the base portion at laterally offset sections, with the ends of the arms thence formed at 90° relative to the vertical access. The arms which extend at 90° are opposed from one another and flank a through hole which extends through the base section of the terminal.

While the above mentioned contact has proven to be useful for the designated application, the contact does have a few drawbacks. First, since the contact portion is formed by the section of the terminal which is folded around the corner from the web which interconnects the contact arm to the terminal, the contact arms have a very low mating force. Secondly, since the terminal base portion lies adjacent to the upper surface of the printed circuit board, the contact has no resiliency or floatation in the vertical direction. Thirdly, there are only two opposed contacts which allows the pin to laterally slide on the contact surfaces.

SUMMARY OF THE INVENTION

The object of the invention then is to design a printed circuit board socket terminal having an increased contact force with a mating pin terminal Another object of the above mentioned invention is to design a pin receptacle having an ability for the receptacle to float in the vertical direction.

It is a further object of the invention to provide for a pin centering feature within the socket.

The above mentioned objects were accomplished by designing an electrical socket terminal for mounting to a printed circuit board, the socket having a metal base portion having printed circuit board contacts, and contact members extending from the base portion for receiving a pin contact terminal between contact sections of the contact members. Contact members extend from opposite side edges of the base portion of the socket terminal and include resilient spring portions which can extend upwardly to form side walls, and that the ends of the contact members are thereafter reversely bent downwardly towards the base portion and in opposing relation.

At least one of the contact members include at its end, a bifurcated contact member which forms two contact arms extending from at least one contact member. In the preferred embodiment, each of the contact members include bifurcated contact arms which project downwardly towards the base portion. Preferably, the contact arms each have a contact surface which faces the center of the base portion of the socket. The contact members include top walls, the side walls of the contact arms extending upwardly to the top walls, and the contact arms extend downwardly from the top wall.

In the preferred embodiment, the root of the bifurcated section is located in the top wall, and arcuate in shape, with the contact arms extending from the top walls and are angled towards the axial centerline of the socket. Preferably, the root portion is greater than 90° and the contact arms extend from the root portion at a tangent to the root portion. The contact arms include a bend adjacent their free ends thereby forming a linear contact surface which is transverse to the axial centerline of the socket.

In the preferred embodiment, the socket further includes a back-up spring which includes a base portion adjacent to the base portion of the socket terminal and resilient arms upstanding therefrom, the resilient arms being positioned adjacent to the contact arms to increase the resiliency of the contact arms. The back up spring resilient arms arm reversely bent, and the free ends of the resilient arms engage the rear surfaces of the contact arms. The contact arms are bent adjacent to their free ends to form inner corners, and the free ends of the contact arms engage the inner corners of the contact arms.

In the preferred embodiment of the invention, the printed circuit board contacts extend from the side edges of the base portion and are reversely bent to extend spring sections under the base portion, which are thereafter bent downwardly. The spring portions are generally parallel to the base portion of the socket terminal.

In the preferred embodiment of the invention, the base portion includes standoff sections extending therefrom which are bent downwardly. The ends of the standoffs are slightly above the lower surface of the spring portions.

BRIEF DESCRIPTION OF THE DRAWINGS

The above mentioned invention will now be described with reference to the drawing figures where.

DETAILED DESCRIPTION OF THE INVENTION

Figure 1:
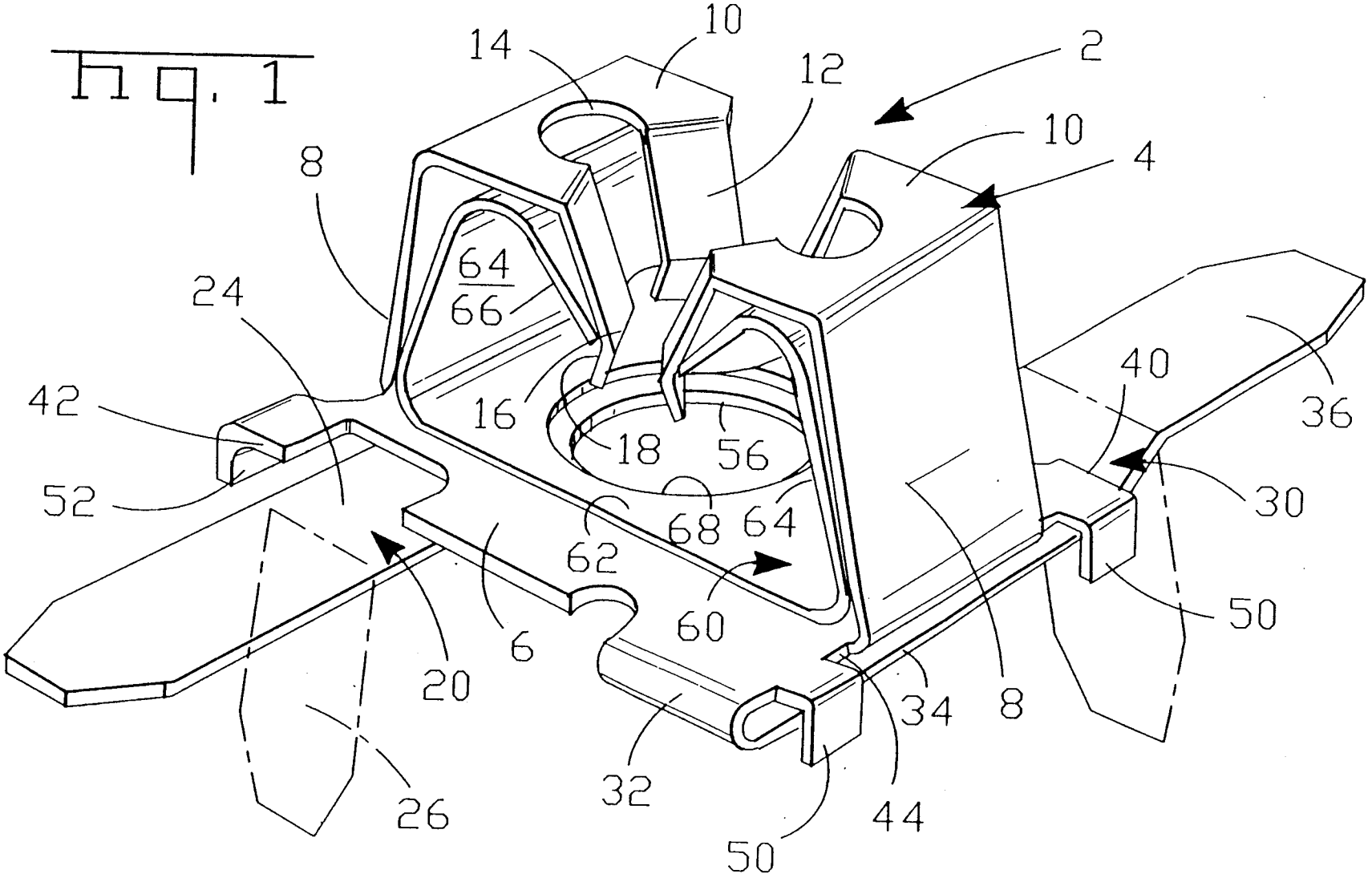
FIG. 1 is an isometric view of the printed circuit board socket.
Figure 2:
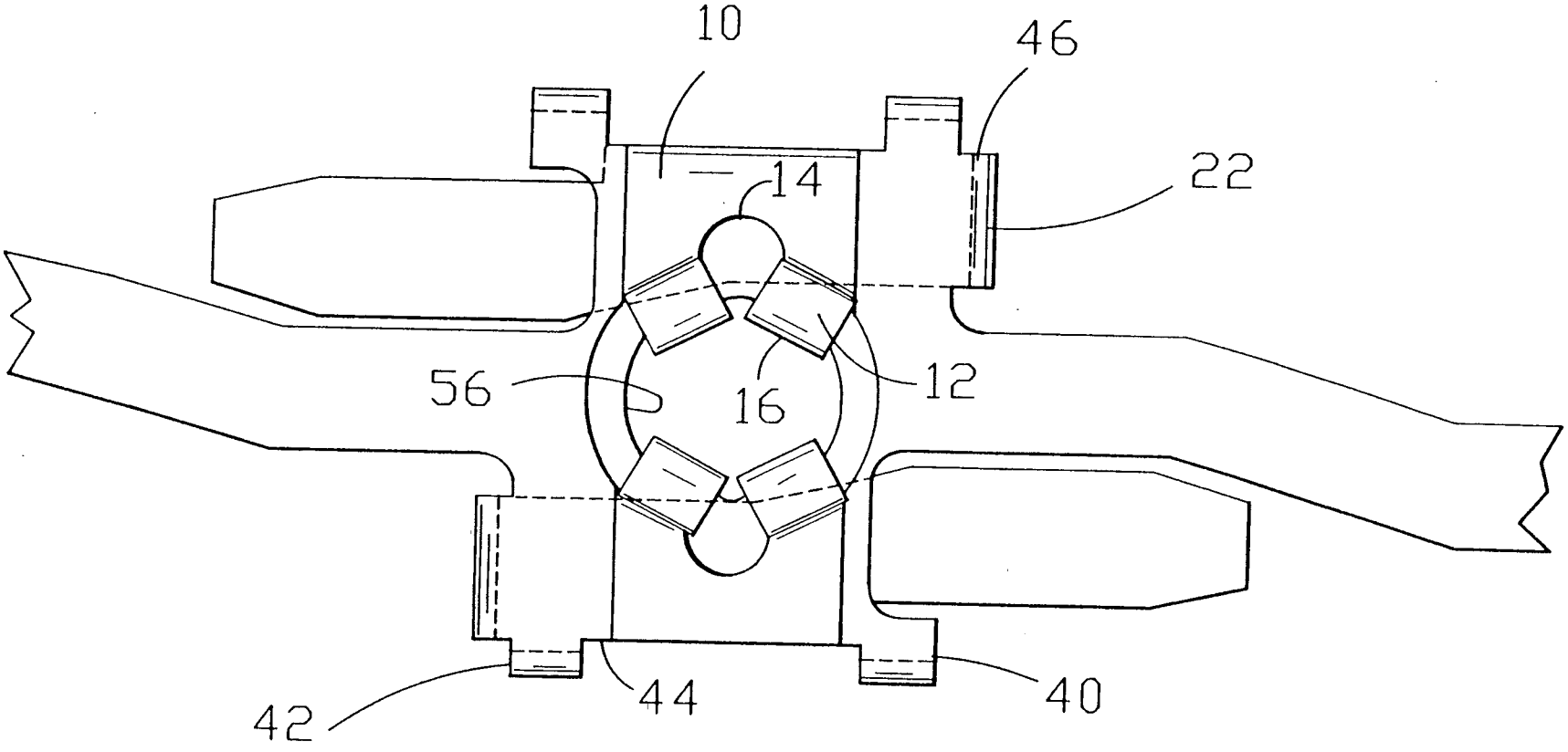
FIG. 2 is an upper plan view of the socket contact still interconnected to its lead frame.

With reference first to FIG. 1, the printed circuit board socket contact 2 generally comprises an outer contact member 4 which comprises a base section 6 having upwardly extending sidewalls 8 which extend from end edges 44 and 46 (FIG. 2) of the base section 6. The sidewalls 8 extend upwardly to a position where the sidewalls are flattened to form top walls 10. Bifurcated contact arms 12 are then bent downwardly to project towards the base surface 6, and thereafter bent proximate its free end to form an inside corner 18 and an exterior linear contact surface 16, the contact surfaces 16 being transverse to the axial direction (pin insertion axis) of the socket. As shown in FIGS. 1 and 2, the contact arms 12 are formed such that the contact surfaces 16 are perpendicular to lines which run through the center of the aperture 56. This is possible since the root of the bifurcated contact arms 12 is an arcuate section 14, of greater than 90°, located in the top wall 10 of the socket contact. Since the contact surfaces 16 face the center of the aperture 56, the contact surfaces 16 tend to center a matable pin upon insertion into the socket 2.

To increase the contact force of the contact arms 12, the socket contact 2 includes a back up spring member 60 which has its own base section 62 lying adjacent to the base section 6 of the socket contact 2. Arms 64 of the back up spring extend upwardly from the base section 62 and they are thereafter folded over to form back-up arms 66 which extends towards the contact arms 12 of the socket contact and engage the contact arms 12 at the corner 18 of the arms 12 as shown best in FIGS. 1 and 3.

To increase the floatational abilities of the socket 2, the printed circuit board contacts 20 and 30 are themselves formed as spring members. As shown best in FIGS. 1 and 3, the printed circuit board contact 20 extends from the side edge 40 and is formed through a radiused section 22 to project a horizontal spring section 24 in a reverse direction generally parallel to the base section 6 of the socket contact member. The contact 20 is thence formed downwardly to form a downwardly extending contact leg 26 as shown in phantom in FIG. 3. Printed circuit board contact member 30 extends from the sidewall 42 through a radiused section 32 to project a horizontal spring section 34 generally parallel to the base section 6 of the socket contact 2. The printed circuit board contact 30 is then bent downwardly towards it free end to form a printed circuit board contact member 36, as shown in phantom in FIG. 3.

The socket 2 also includes stand off members 50 which extend from the end edge surface 44 and stand off members 52 which extend from the end edge surface 46. As shown best in FIG. 3, the end of the stand off 50 includes an edge 51 which is slightly higher than the lower surface 35 of the horizontal arm 34. Similarly, the end edge of the stand off member 52 has an edge surface 53 which is slightly higher than the under surface 25 of the horizontal portion 24.

Figure 5:
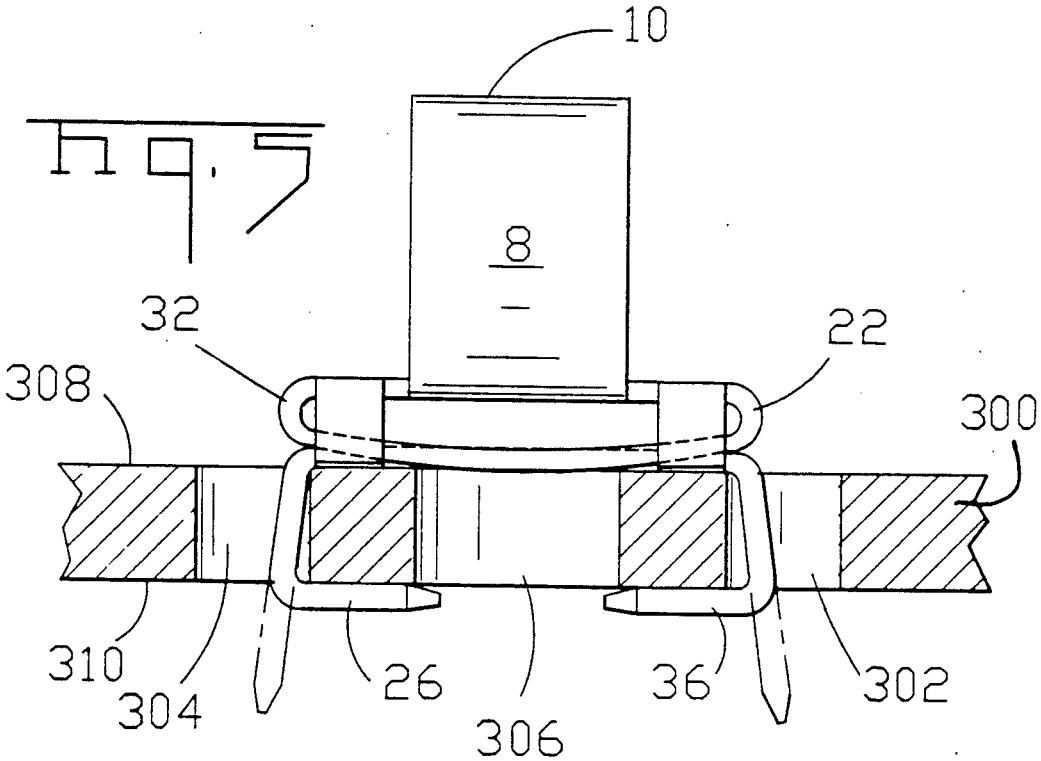
FIG. 5 is a view similar to that of FIG. 4 showing the socket contact in a retained manner to the printed circuit board.

To install the contact in the printed circuit through hole, the arm 36 is inserted into the through hole portion 302 whereas the arm portion 26 is inserted through the through hole portion 304 of the printed circuit board 300 and the arms 26 and 36 are folded back on themselves to retain the socket to the printed circuit board, as shown in FIG. 5.

Figure 3:
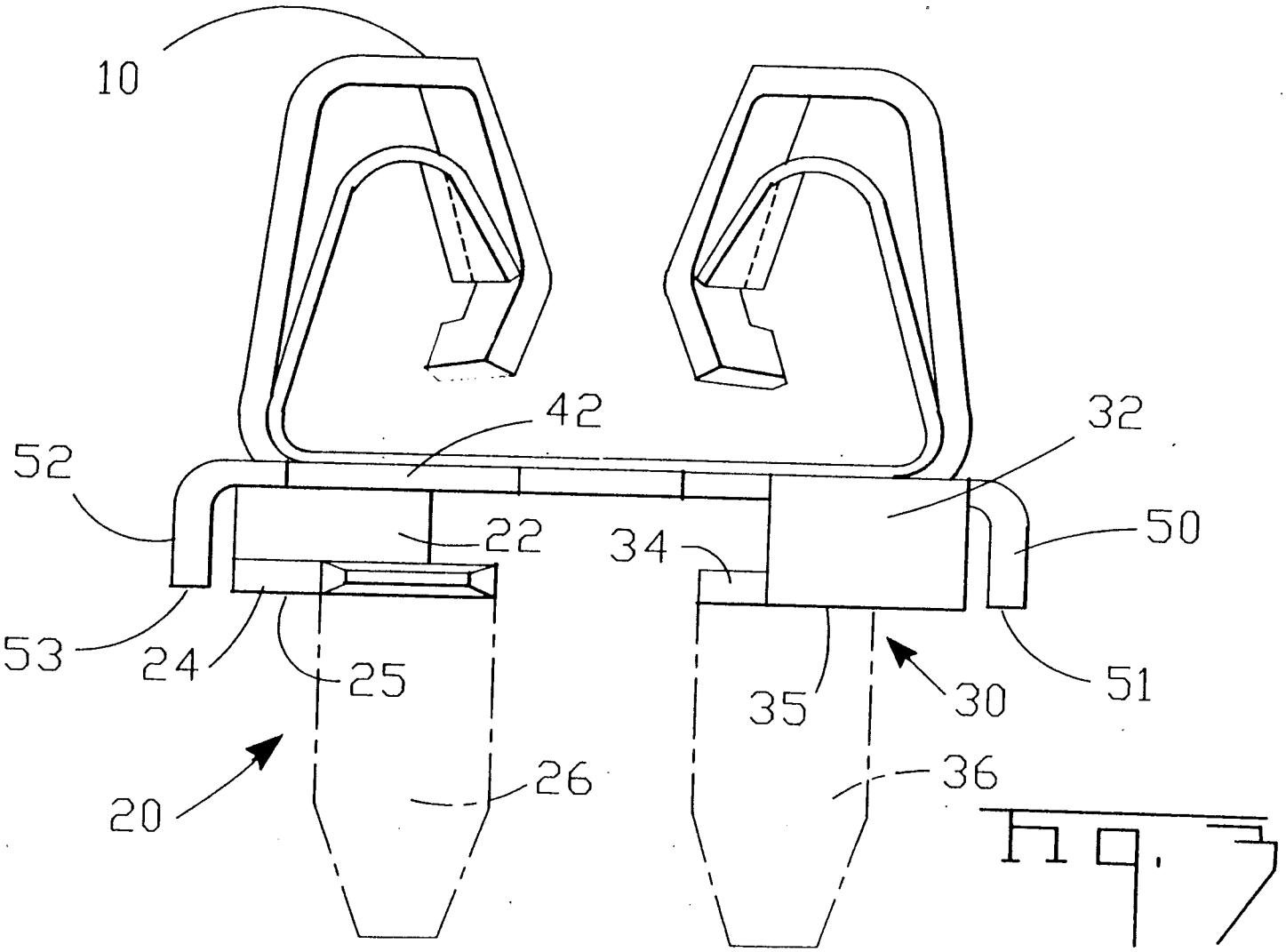
FIG. 3 is a side plan view of the printed circuit board socket contact.
Figure 4:
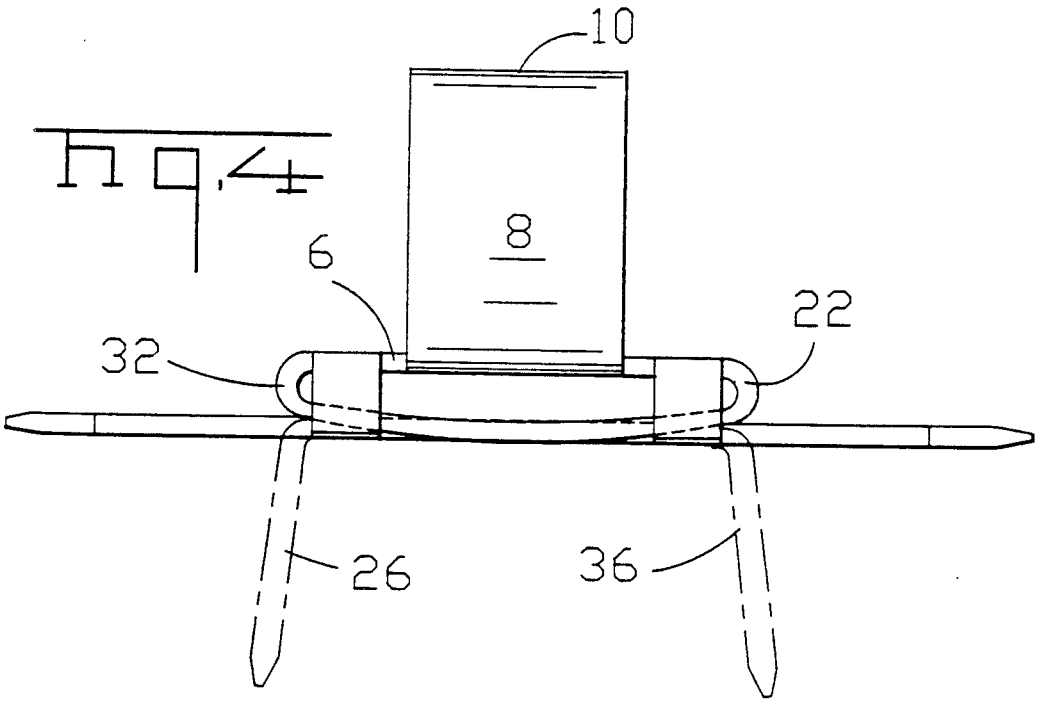
FIG. 4 is an end view of the printed circuit board socket contact.

Thus, the above mentioned socket contact has achieved the desired objectives. The socket contact 2 has exceptional mating force due to the back-up spring member 60. The contact also has a centering feature provided by the angle contact arms 12 facing the axial centerline of the socket. The socket also has better floatation than the design presently available. Due to the spring arms 24, 34, the socket is moveable downwardly towards the printed circuit board 300, to the extent of the distance between surfaces 50, 51; 52, 53; as shown in FIG. 3. The stop surfaces provided for a positive stop in the vertical direction to prevent overstressing the socket contact. The socket contact base section 6 can also move upwardly, for example due to heat expansion, due to the springs arms 24, 34.

Figure 6:
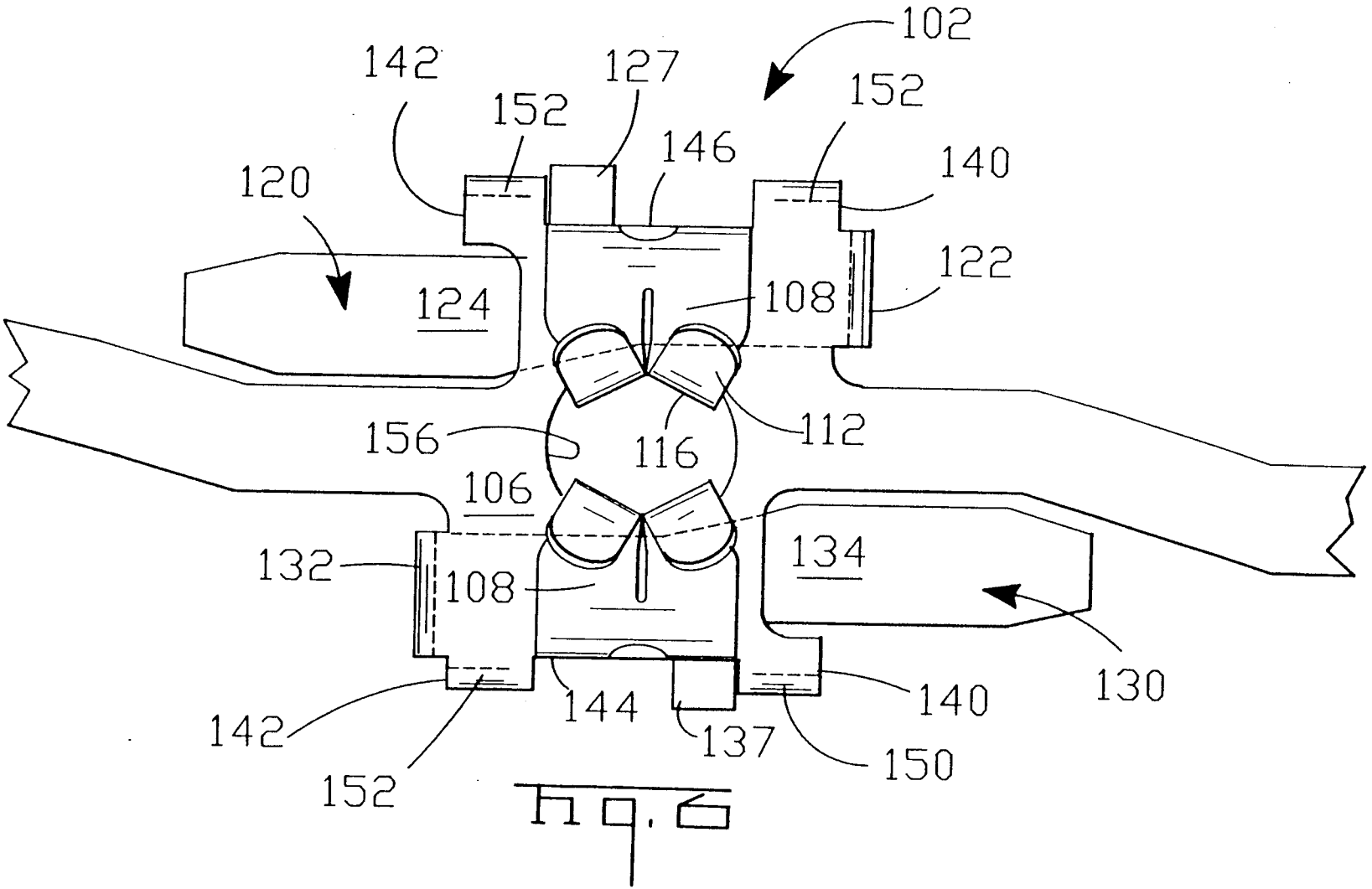
FIG. 6 is an upper plan view of an alternative embodiment of the socket contact still interconnected to its lead frame.
Figure 8:
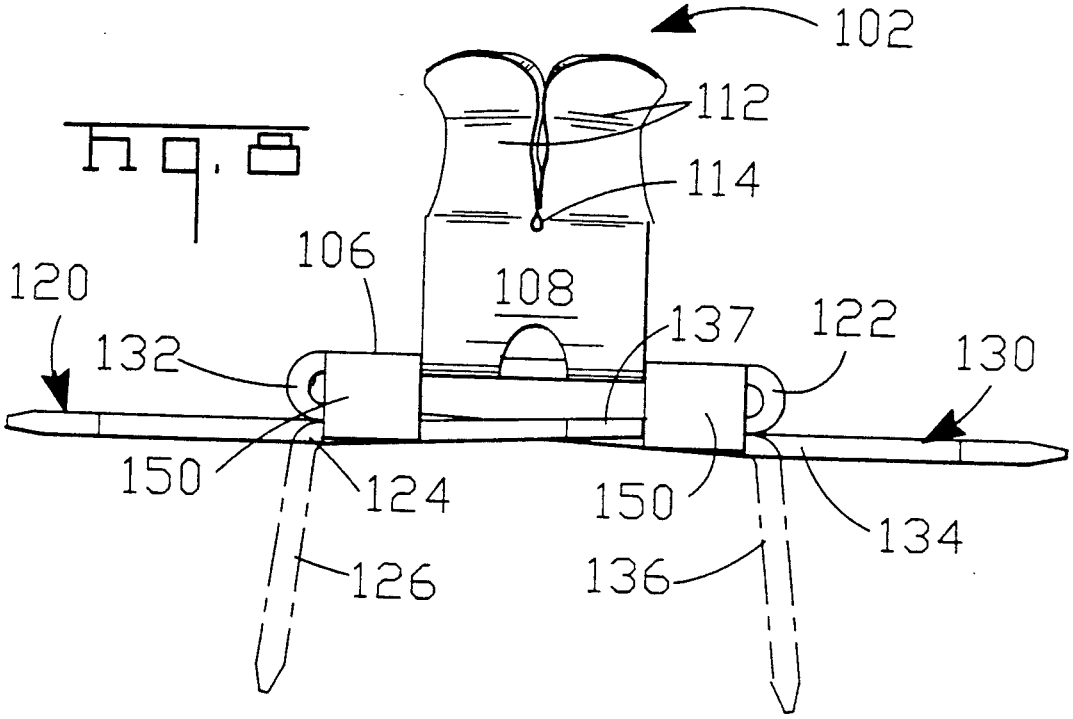
FIG. 8 is an end view of the alternate printed circuit board socket contact.

With reference now to FIG. 8, the printed circuit board socket contact 102 generally a base section 106 having upwardly extending sidewalls 108 which extend from end edges 144 and 146 (FIG. 6) of the base section 106. The sidewalls 108 extend upwardly to a position where the sidewalls are bifurcated to form contact arms 112. The bifurcated arms 112 are also inwardly directed towards the axial centerline of the socket to form contact surfaces 116, the contact surfaces 116 being transverse to the axial direction (pin insertion axis) of the socket. As shown in FIG. 6, the contact arms 112 are formed such that the contact surfaces 116 are perpendicular to liens which run through the center of the aperture 156. Since the contact surfaces 116 face the center of the aperture 156, the contact surfaces 116 tend to center a matable pin upon insertion into the socket 102.

To increase the floatational abilities of the socket 102, the printed circuit board contacts 120 and 130 are themselves formed as spring members. As shown best in FIGS. 6 and 8, the printed circuit board contact 120 extends from the side edge 140 and is formed through a radiused section 122 to project a horizontal spring arm 124 in a reverse direction generally parallel to the base section 106 of the socket contact member 102. The contact 120 is thence formed downwardly to form a downwardly extending contact leg 126 as shown in phantom in FIG. 8. Printed Circuit board contact member 103 extends from the sidewall 142 through a radiused section 132 to project a horizontal spring section 134 generally parallel to the base section 106 of the socket contact 102. The printed circuit board contact 130 is then bent downwardly adjacent to its free end to form a printed circuit board contact member 136, as shown in phantom in FIG. 8.

The socket 102 also includes stand off members 150 which extend from the en edge surface 144 and stand off members 152 which extend from the end edge surface 146. As shown best in FIG. 7, the end of the stand off 150 includes an edge 151 which is slightly higher than the lower surface 135 of the horizontal arm 134. Similarly, the end edge of the stand off member 152 has an edge surface 153 which is slightly higher than the under surface 125 of the horizontal portion 124.

The socket contact 102 also includes strain relief ears 127 and 137 integral with the respective contact arms 120 and 130. The strain relief ears 127 and 137 abut the edge of the respective stop members 150 and 152 as best shown in FIG. 6. These ears prevent the arms 120 and 130 from shifting laterally inward during the formation of the vertical bend which forms the printed circuit board contacts 126, 136 as shown in phantom in FIG. 8.

Figure 9:
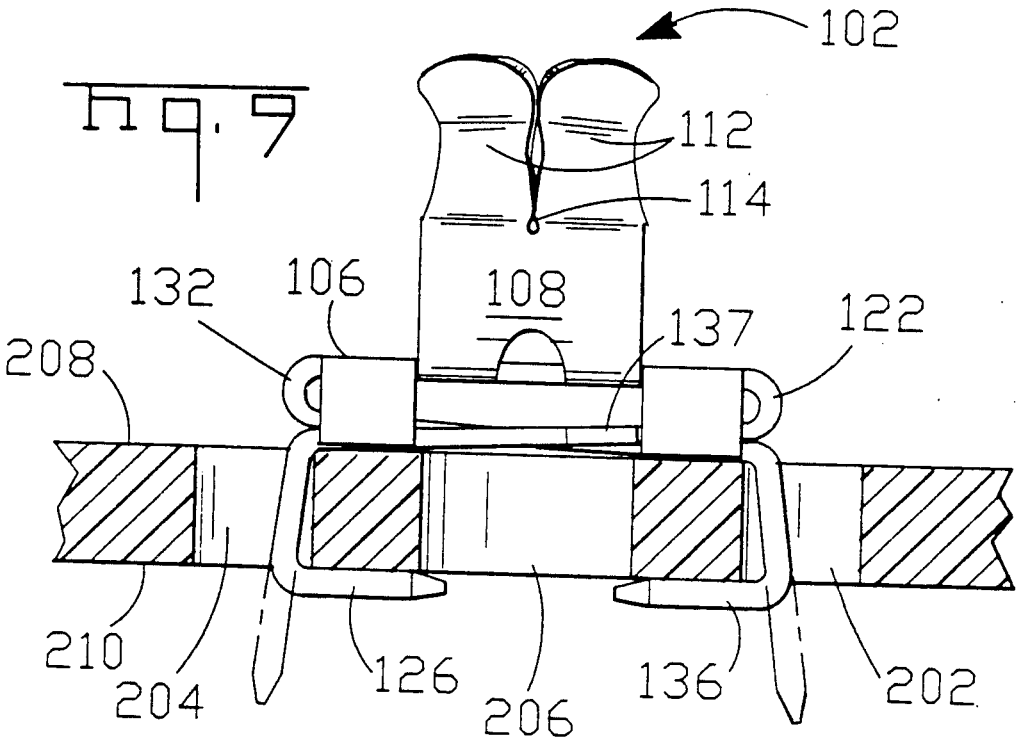
FIG. 9 is a view similar to that of FIG. 8 showing the socket contact in a retained manner to the printed circuit board.

To install the contact in the printed circuit through hole, the arm 136 is inserted into the through hole portion 202 whereas the arm portion 126 is inserted through the through hole portion 204 of the printed circuit board 200 and the arms 126 and 136 are folded back on themselves to retain the socket to the printed circuit board, as shown in FIG. 9.

Figure 7:
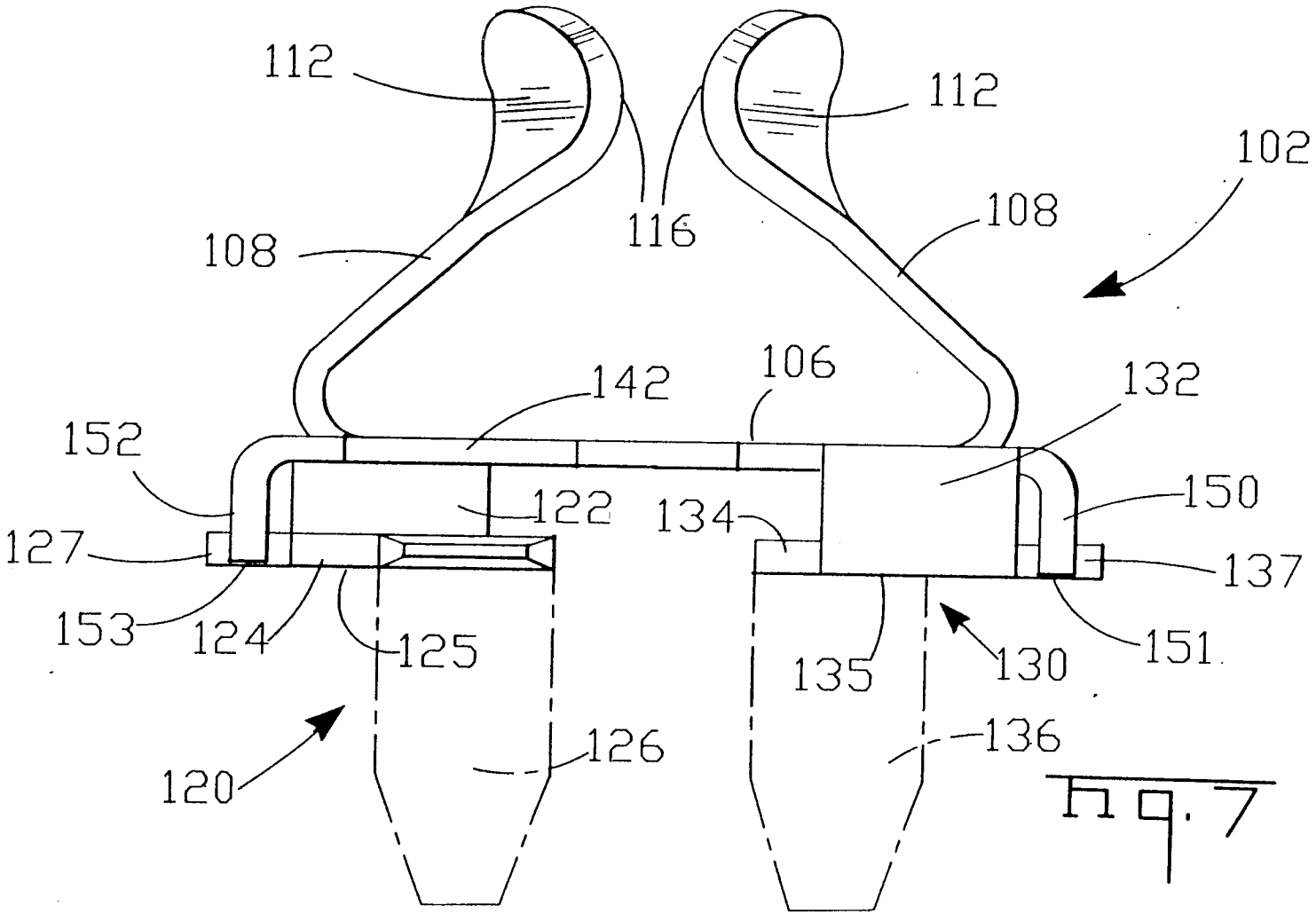
FIG. 7 is a side plan view of the alternate printed circuit board socket contact.

Thus, the above mentioned socket contact has achieved the desired objectives. The socket contact 102 has exceptional mating force due to the two bifurcated contacts 116. The contact also has a centering feature provided by the angled contact arms 112 facing the axial centerline of the socket. The socket also has better floatation than the design presently available. Due to the spring arms 124, 134, the socket is moveable downwardly towards the printed circuit board 200, to the extent of the distance between surfaces 150, 151; 152, 143; as shown in FIG. 7. The stop surfaces provided for a positive stop in the vertical direction to prevent overstressing the socket contact. The socket contact base section 106 can also move upwardly, for example due to heat expansion, due to the spring arms 124, 134.

What is claimed is:

1. An electrical socket terminal for mounting to a printed circuit board, the socket terminal having a metal base portion having printed circuit board contacts, and contact members extending from the base portion for receiving a pin contact terminal between contact sections of the contact members, the printed circuit board contacts extend from opposite side edges of the base portion and include resilient spring portions intermediate the side edges of the base portion and the free ends of the printed circuit board contacts, the spring portions are defined by arms extending from the opposite side edges of the base portion and thereafter reversely bent beneath the base portion, the printed circuit board contacts being thereafter reversely bent downwardly.

2. The socket terminal of claim 1 wherein the contact sections are defined by plate sections extending upwardly from side edges of the base portion.

3. The socket terminal of claim 2 wherein the plate sections include bifurcated arms extending inwardly towards the center of the base portion.

4. The socket terminal of claim 1 wherein the contact members extend from opposite side edges of the base portion and extend upwardly to form side walls, the ends of the contact members thereafter being reversely bent downwardly towards the base portion and in opposing relation.

5. The socket terminal of claim 4 wherein at least one of the contact members include at its end, a bifurcated contact member which forms two contact arms extending from at least one contact member.

6. The socket terminal of claim 5 wherein each of the contact members include bifurcated contact arms which project downwardly towards the base portion.

7. The socket terminal of claim 6 wherein the contact arms each have a contact surface which faces the center of the base portion of the socket terminal.

8. The socket terminal of claim 7 wherein the contact members include top walls, the side walls of the contact arms extending upwardly to the top walls, and the contact arms extend downwardly from the top wall.

9. The socket terminal of claim 4 wherein the socket terminal further includes a back-up spring which includes a base portion adjacent to the base portion of the socket terminal and resilient arms upstanding therefrom, the resilient arms being positioned adjacent to the contact arms to increase the resiliency of the contact arms.

10. An electrical socket terminal for mounting to a printed circuit board, the socket having a metal base portion having printed circuit board contacts, and contact members extending from the base portion for receiving a pin contact terminal between contact sections of the contact members, the socket terminal being characterized in that the contact members extend from opposite side edges of the base portion and extend upwardly to form side walls, the ends of the contact members thereafter being reversely bent downwardly towards the base portion and in opposing relation, the printed circuit board contacts extend from other opposite side edges of the base portion and are reversely bent to extend spring sections under the base portion, which are thereafter bent downwardly.

11. The socket terminal of claim 10 wherein the contact members include a bend adjacent their free ends thereby forming a linear contact surface.

12. The socket terminal of claim 11 wherein the linear contact surfaces are transverse to the axial centerline of the socket.

13. The socket terminal of claim 10 wherein the socket further includes back-up spring which includes a base portion adjacent to the base portion of the socket terminal and resilient arms upstanding therefrom, the resilient arms being positioned adjacent to the contact members to increase the resiliency of the contact arms.

14. The socket terminal of claim 13 wherein the back-up spring resilient arms are reversely bent, and the free ends of the resilient arms engage the rear surfaces of the contact members.

15. The socket terminal of claim 10 wherein the spring portions are generally parallel to the base portion of the socket terminal.

16. The socket terminal of claim 15 wherein the base portion includes standoff sections extending therefrom which are bent downwardly.

17. The socket terminal of claim 16 wherein the end of the standoffs is slightly above the lower surface of the spring portions.

* * * * *